United States Patent [19]

Burch

[11] 4,325,046

[45] Apr. 13, 1982

[54] CIRCUIT BREAKER

[75] Inventor: Hadley K. Burch, Pittsfield, Vt.

[73] Assignee: B/K Patent Development, Inc., Highland Park, Ill.

[21] Appl. No.: 137,399

[22] Filed: Apr. 4, 1980

[51] Int. Cl.[3] ..... H01H 71/16

[52] U.S. Cl. ..... 337/56; 337/358

[58] Field of Search ..... 337/56, 89, 72, 75, 337/76, 78, 85, 358, 359, 362, 365

[56] References Cited

U.S. PATENT DOCUMENTS

Re. 28,578 10/1975 Burch et al. ..... 200/67 DA
3,778,739 12/1973 Burch ..... 337/75 X
3,913,049 10/1975 Burch ..... 337/75
4,032,876 6/1977 Burch ..... 337/75

*Primary Examiner*—George Harris
*Attorney, Agent, or Firm*—Kenway & Jenney

[57] ABSTRACT

A current activated actuator formed from a flat sheet of metal has diverging legs mounted in a base, the legs extending from an upper portion of the actuator. A snap action element is mounted on the upper portion and is located between spaced apart contacts. Overload current through one of the legs via a connection on the leg bottom causes the actuator to become vertically offset, moving the snap action element from contact with one of the spaced apart contacts to the other. Reset current through the other leg causes the snap action element to return to its original position.

5 Claims, 5 Drawing Figures

CIRCUIT BREAKER

BACKGROUND

This invention relates to circuit breakers and particularly to ambient compensated remotely resettable circuit breakers.

The typical circuit breaker has characteristics that become significant drawbacks under certain operating conditions. For example, if a bimetallic element is part of the breaker, the use of the breaker in environments where extreme temperature conditions exist is handicapped by the effect the temperature has on the operating characteristics of the bimetallic element. Certain ambient compensated circuit breakers have been devised to overcome this handicap. For example, U.S. Pat. No. 4,032,876 of Lyndon W. Burch shows a circuit breaker having a monometallic element with fixed divering legs. Load current flows through one of the legs. When the current reaches overload magnitude, the thermal expansion of the leg causes it to bend and unlatch a biased element to break circuit continuity.

The resetting of circuit breakers can present other problems. Often it is desirable to reset the circuit breaker from a remote location. If space and weight are significant factors, the resetting technique must be carefully chosen. In particular situations, for example, an electromechanical solenoid reset arrangement would be unsatisfactory because of the size of the solenoid. Also the large current necessary to operate a solenoid requires heavy conductors to power the solenoid. A typical environment in which all the foregoing adverse factors are present is the airplane, in which temperature extremes occur routinely, and in which space and weight considerations are vital.

Accordingly, it is an object of this invention to provide a circuit breaker that is substantially independent of ambient temperature and that is remotely resettable with minimal current. Other objects of the invention are to provide a circuit breaker that is reliable, inexpensive to produce, and lightweight.

SUMMARY OF THE INVENTION

The invention attains the foregoing and other objects by providing an ambient compensated remotely-resettable circuit breaker including a metal strip member having first and second divergent legs that are joined at an upper portion, with the lower portions being spaced apart and fixed to a base. The common upper portion is movable from a first to a second position in response to expansion of the first leg and movable from the second back to the first position in response to expansion of the second leg. The circuit breaker includes spaced apart contacts that electrically contact the strip upper portion. A first contact engages the upper portion when it is in its first position, and a second contact engages it when it is in its second position.

The bottom portions of the first and the second legs have electrical connections. The first contact is connected through the load and a power source to the electrical connection on the first leg. The second contact is connected through a reset switch and the power source to the connection on the second leg. Thus, a current path in the first leg is provided during operation of the load. When the current becomes high, the leg expands and the element moves to its second position. If the reset switch is closed, the second leg becomes a current path, heats up and expands, and returns the strip element to its first position.

In a preferred embodiment, the strip member is a three legged element formed from a flat piece of metal. Furthermore, a snap action element is attached to the common upper portion of the strip member to engage the first or second contact. The strip member is arranged so that force toward the contact causes the snap action member to snap to the other contact and vice versa.

BRIEF DESCRIPTION OF THE DRAWING

Other objects, features and advantages of the invention will be pointed out hereinafter, or will be apparent from the following description of a preferred embodiment, including the drawing thereof, in which.

DESCRIPTION OF THE PREFERRED EMBODIMENT

Figure 1:
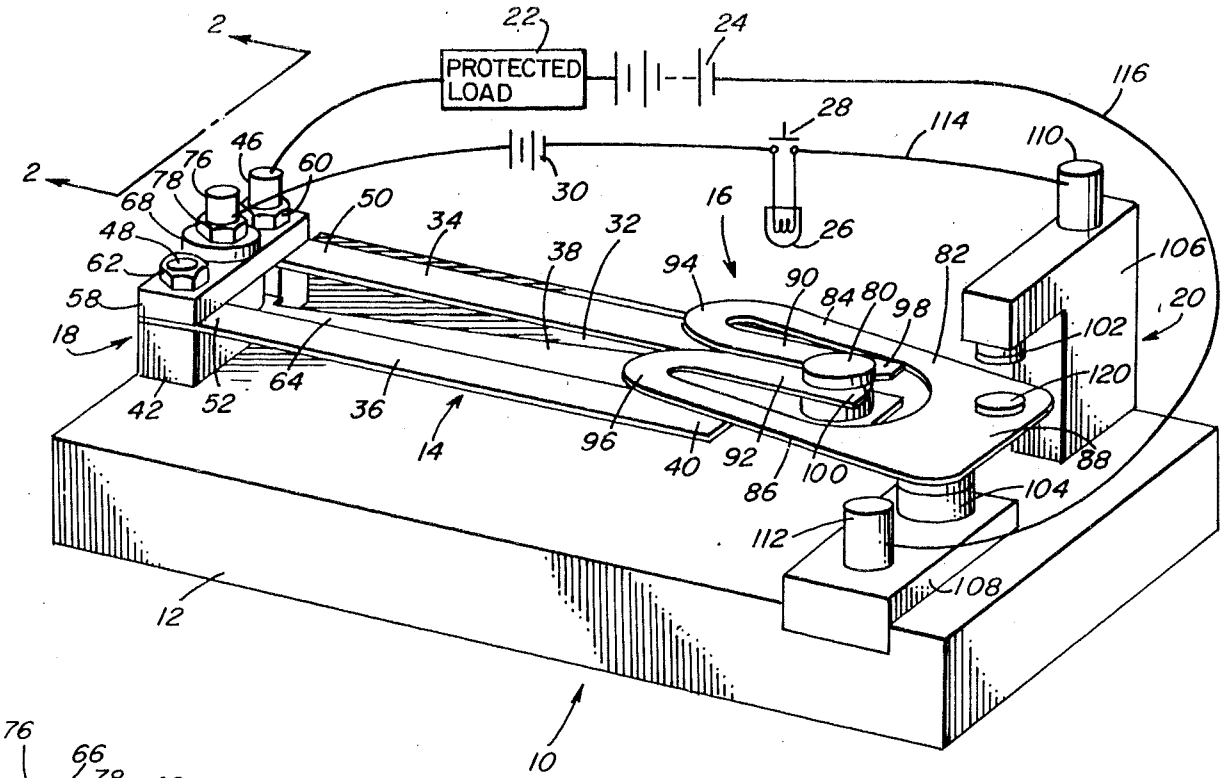
FIG. 1 is a perspective view of a circuit breaker constructed according to the invention with elements of the attached electrical circuit shown diagrammatically.

Referring to FIG. 1, a circuit breaker 10 embodying the invention is formed on a plastic insulating base 12 and includes a monometallic flexible actuator element 14 joined to a snap switch 16. The flexible element 14 is mounted on a terminal base 18. The snap switch 16 extends to a contact assembly 20. The circuit breaker 10 is in a circuit, shown in diagrammatic form, containing an electrical load 22, a primary electrical power source 24, an indicator light 26, a reset switch 28, and a secondary electrical power source 30.

The illustrated flexible element 14 is made from a flat piece of monometal such as brass, in which a pair of slits 32 are provided in the lower end (at the left in FIG. 1), thus forming outer legs 34 and 36 and an inner, central leg 38. The slits 32 do not extend the entire length of the flexible element 14, leaving an undivided portion 40 at the upper end.

Figure 2:
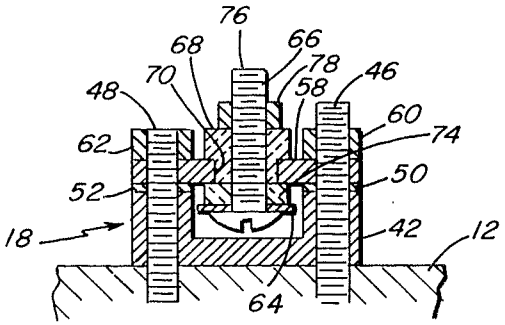
FIG. 2 is a fragmentary sectional view, along the line 2—2 of FIG. 1, of the terminal base of the circuit breaker.

The terminal base 18, shown also in FIG. 2, has a U-shaped brass support 42 with two holes 44, 49 through which metal bolts 46 and 48 pass to be threadedly connected to holes in the insulating base 12. The lower ends 50 and 52 of the outer legs 34 and 36 slip over the bolts 46 and 48 extending above the support 42, by way of holes 54 and 56 provided in the legs for that purpose. A brass cross piece 58 is mounted on the bolts 46, 48, sandwiching the leg lower ends 50 and 52 between it and the support 42. Nuts 60 and 62 threaded onto the top of bolts 46, 48 secure the elements to the base 12.

The lower end 64 of the central leg 38 is connected to the terminal base 18 by a metal bolt 66 threaded into an electrically insulting ceramic insert 68 mounted in a central hole 70 in the cross piece 58. The bolt 66 is inserted into the insert 68 from the bottom, through a hole 72 (see FIG. 3) in the central leg 38, then through an electrically insulating ceramic displacement washer 74. The end 76 of the bolt 66 projecting past the insert 68 has a nut 78 threadedly connected to it. As thus mounted, it will be observed that, at the terminal base 18, the central leg 38 is displaced out of alignment with the outer legs 34, 36. Hence the central leg 38 is divergent relative to the legs 34 and 36.

It will also be observed that the metal bolt 66 provides an electrical connection to the lower end 64 of the central leg 38. Either bolt 46 or 48 provides an electrical connection to the outer legs 36, 38 simultaneously by virtue of the electrically conductive cross piece 58. For convenience, one bolt 46 is selected to be the joint electrical connection for both outer legs 34, 36. By virtue of the arrangement of elements in the terminal base 18, i.e. by insulating elements 68 and 74, the electrical connection to the outer legs 34, 36 is electrically insulated from the electrical connection to the central leg 38.

Figure 3:
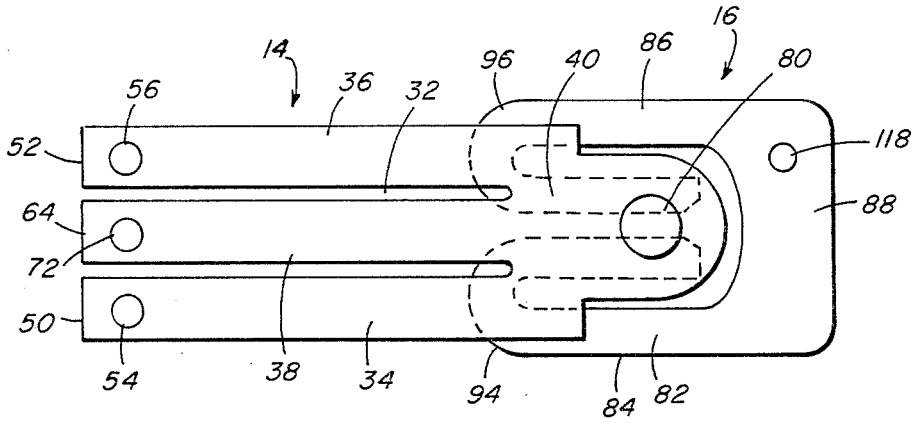
FIG. 3 is a bottom view of the metallic strip element and the snap action element of the breaker.

With reference to FIGS. 1 and 3, the undivided upper portion 40 of the flexible element 14 is connected by an electrically conductive plug 80 to the snap switch 16. The snap switch 16 is an M-shaped blade 82 which is a sheet-like flat member constructed of resilient electrically conductive material such as phosphor bronze or beryllium copper. It includes a pair of spaced-apart, parallel, coextensive outer arms 84, 86 that have one pair of adjacent ends connected together by an integral connector bar 88 which extends therebetween. Parallel, coextensive inner arms 90, 92, shorter than the outer arms 84, 86, are disposed with the space defined by the outer arms 84, 86. These are joined to the other ends of the outer arms 84, 86 by arcuate integral connections 94, 96. The free ends 98, 100 of the inner arms 90, 92 terminate adjacent to, but spaced from, the connector bar 88. The blade 82 thus comprises two sheet metal loops adjacent to one another, in the form of an M; the outer arms 84, 86 of the loops being joined by the connector bar 88, and the inner arms 90, 92 having free ends 98, 100. Greater detail about the construction and operation of the snap switch 16 may be found in U.S. Pat. No. Re. 28,578, which is expressly incorporated herein by reference.

The contact assembly 20, FIG. 1, has spaced apart upper and lower contacts 102, 104, each mounted on a rigid conductive contact support 106, 108 secured to the base 12. The contacts 102, 104 are connected by internal wiring (not shown) to external terminals 110, 112.

The upper terminal 110 (connected to the upper contact 102) is connected by an electrical cable 114 in series with the indicator light 26 and the secondary power source 30 to the end 76 of bolt 66, which is an electrical connection to the bottom end 64 of the flexible element central leg 38. (The indicator light 26 is shunted by the normally open reset switch 28.) The lower terminal 112 (connected to the lower contact 104) is connected by an electrical cable 116 in series with the protected load 22 and the primary power source 24 to bolt 46, which is an electrical connection to the bottom ends 50, 52 of the flexible element outer legs 34, 36.

The connector bar 88 of the snap switch 18 is disposed between the vertically-spaced contacts 102, 104 of the contact assembly 20. The bar 88 carries a downwardly facing contact 118 opposite the lower contact 104, and carries an upwardly facing contact 120 opposite the upper contact 102. Both connector bar contacts 118 and 120 are mounted for electrical continuity with the connector bar 88.

The plug 80, which mounts the snap switch 16 on the flexible element 14, stresses the arms 90, 92 of the M-shaped blade 82. As a result, the two loops of the blade are unstable so that they snap from one vertically-offset side to the other when a force is applied. When the snap switch 16 is in the downward position shown in FIGS. 1 and 4, in which the connector bar contact 118 is in physical and electrical contact with the lower contact 104 of the contact assembly 20, a downward force applied to the plug 80 to the M-blade 82 (while contact 118 presses against contact 104) causes the connector bar 88 to snap in the opposite direction, i.e. upward, bringing connector bar contact 120 into contact with upper contact 102, as seen in FIG. 5. Conversely, when the snap switch 16 is in the upward position shown in FIG. 5, an upward force applied to the plug 80 (while contact 120 presses against contact 102) causes the connector bar 88 to snap back, re-establishing contact between the connector bar contact 118 and the lower contact 104.

Figure 4:
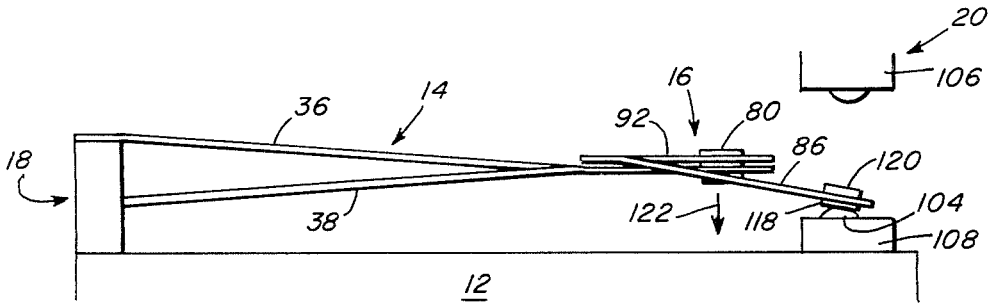
FIG. 4 is a side elevation view of the breaker in a first position in which the electrical load is connected in the circuit.
Figure 5:
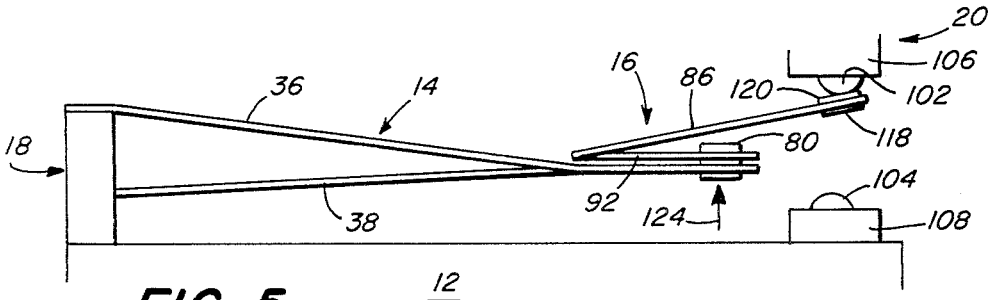
FIG. 5 is a view similar to that of FIG. 4, except that the breaker is in a second position.

In operation of the circuit breaker 10, the normal operating position of the breaker is the position shown in FIGS. 1 and 4, i.e., connector bar contact 118 is in contact with lower contact 104 because the connector bar 88 of the snap switch 16 is in the downward position. In this position, a primary circuit is formed in which current flows through electrical cable 116 from the primary source 24, through the protected electrical load 22, and through the electrical connector bolt 46 to the lower ends 50 and 52 of the outer legs 34 and 36 of the flexible element 14. The current path continues in the outer legs 34, 36 to the flexible element upper portion 40, and through the plug 80 to the snap switch 16. The current path proceeds through the M-blade 82 and the contact 118 to the lower contact 104, connected to the lower terminal 112 and the electrical cable 116, which completes the circuit. There is no appreciable current, in this position of the circuit breaker 10, through the central leg 38 of the flexible element, because the lower end 64 of the central leg 38 is insulated from the electrical connector bolt 46.

The components of the flexible actuator element 14 are selected so that a current through the electrical cable 116 that slightly exceeds the normal current required by the electrical load 22 does not change this position of the circuit breaker 10. However, if the circuit draws excessive current through the circuit breaker, e.g. because of a short circuit in the load element 22, the heat generated in the outer element legs 34 and 36 by the excess current causes the legs to expand. Because of the geometry of the flexible element 14, this causes the legs 34 and 36 to elongate relative to leg 38 and hence to bend the element 14 downwardly. This action exerts a downward force on the upper portion 40 of the element bearing the plug 80 (in the direction of the arrow 122 of FIG. 4). As explained above, such a downward force causes the connector bar 88 of the switch 16 to snap up, to the position shown in FIG. 5.

In this position, the electrical load 22 is disconnected from the primary power source because of the open circuit caused by the disengagement of the connector bar contact 118 from the lower contact 104. Current now flows through a secondary circuit comprising connector bar contact 120, upper contact 102, contact assembly terminal 110, the electrical cable 114, the indicator light 26, a secondary power source 30, and the end 76 of the bolt 66. The bolt 66 is electrically connected to the bottom end 64 of the central leg 38 of the flexible element 14, allowing current to pass down the central leg 38 to the flexible element upper portion 40, and the M-blade 82 of the snap switch 16, to the upward facing contact 120. The indicator light 26 goes on to indicate that the circuit breaker 10 has disconnected the electrical load 22.

To reset the breaker 10, the normally open reset switch 28 is closed. This bypasses the indicator light 26, decreasing the load impedance in the circuit connected by the electrical cable 114 and thereby increasing the current. The increased current causes an increase of heat in the flexible element central leg 38 and, therefore, causes the central leg 38 to expand. Expansion of the central leg 38 relative to the other legs 34 and 36 causes an upward force on the upper portion 40 of the flexible element 14 (in the direction of the arrow 124 of FIG. 5). The upward force causes the connector bar 88 of the snap switch 16 to snap down, thereby resetting the circuit breaker back to the normal position shown in FIG. 4.

Of course, if the electrical malfunction that caused the breaker 10 to trip in the first place has not been cleared, the breaker will open the primary load circuit again. But if the malfunction has been cleared, the reset closed primary circuit will operate and the protected load 22 will once again be connected to the primary power source 24.

Since the outer legs 34 and 36 of the flexible nonmetallic element 14 and the divergent central leg 38 are of equal length, expansion or contraction of the legs 34, 36 and 38 by ambient temperature change will affect them equally, making the breaker independent of the ambient temperature. Very little current is required to operate the flexible element 14 with the snap switch 16 attached, although a reliable, positive acting, change of positions is nevertheless accomplished. By making the current sensitive, circuit breaking element reversible, a compact, efficient and lightweight circuit breaker is created.

The preferred embodiment described above is, of course, only illustrative of the invention. For example, the circuitry of the reset circuit could be modified, as by having the source of power for the reset circuit be the primary power source. While DC power sources are shown in the illustrative embodiment, they may be AC sources. The flexible element may be made up of two or four legs rather than three. Other modifications of the illustrated embodiment, including deletion or addition of elements may be devised by those skilled in the art and be within the scope of the invention, as defined by the following claims.

I claim:

1. An ambient-compensated remotely-resettable circuit breaker comprising:

a base, a metal strip member having first and second divergent legs, said legs being joined at an upper portion, said legs having lower portions spaced apart and fixed to said base, said upper portion being movable from a first to a second position in response to current in excess of a selected value through said first leg, and movable from the second back to the first position in response to current in excess of a selected second value through said second leg, a contact assembly having fixed, spaced apart first and second contacts for electrically contacting said upper portion, and first contact engaging the upper portion in its said first position and said second contact engaging the upper portion in its said second position, a first electrical connection electrically connected to said first leg, and a second electrical connection electrically connected to said second leg, said first electrical connection being connectable through an electrical load to said first contact, and said second electrical connection being connectable through a reset switch to said second contact.

2. The circuit breaker of claim 1 in which said metal strip member comprises an elongate flat piece of metal having two elongate parallel slits at one end to form three legs, comprising two outer legs and one central leg, said outer legs and said central leg diverging.

3. The circuit breaker of claim 1 including a snap action element electrically connected to said upper portion and electrically engageable with said spaced apart contacts, said snap action element being arranged so that movement of said upper portion from said first to said second position causes said snap action element to snap from electrical engagement with said first contact to said second contact, and movement of said upper portion from said second to said first position causes said snap action element to snap from electrical engagement with said second contact to said first contact.

4. An ambient-compensated remotely-resettable circuit breaker comprising:

a base, a conductive, current responsive actuator element, having an upper portion, and at least first and second legs extending from said upper portion to said base, said legs having lower portions spaced apart and fixed to said base, each leg being responsive to current in said leg in excess of a selected value to offset said upper portion between first and second positions, and each leg having an electrical terminal at its lower portion, a contact assembly bearing fixed, spaced apart contacts, a mechanically bistable conductive element carrying contacts on first and second opposed faces disposed between said fixed, spaced apart contacts, said bistable element being mechanically responsively connected to said actuator element upper portion to move said contacts on said first and second faces from bearing contact with one of said fixed, spaced apart contacts to the other, in response to said offset movement of said upper portion.

5. The circuit breaker of claim 4 further including means forming a primary circuit between the electrical terminal of one of said legs and one of said fixed, spaced apart contacts, including a source of electrical power and an electrical lead, and means forming a secondary circuit between the electrical terminal of the other of said legs and the other of said fixed, spaced apart contacts, including a reset switch means.

* * * * *

UNITED STATES PATENT AND TRADEMARK OFFICE

CERTIFICATE OF CORRECTION

PATENT NO. : 4,325,046

DATED : April 13, 1982

INVENTOR(S) : Hadley K. Burch

It is certified that error appears in the above-identified patent and that said Letters Patent are hereby corrected as shown below:

Column 6, line 1, cancel "and" and substitute --said--

Signed and Sealed this

*First* Day of *March 1983*

[SEAL]

*Attest:*

GERALD J. MOSSINGHOFF

*Attesting Officer*

*Commissioner of Patents and Trademarks*